US011079722B2

(12) United States Patent
Charbon

(10) Patent No.: US 11,079,722 B2
(45) Date of Patent: Aug. 3, 2021

(54) COMPONENT FOR A TIMEPIECE MOVEMENT

(71) Applicant: NIVAROX-FAR S.A., Le Locle (CH)

(72) Inventor: Christian Charbon, Chezard-St-Martin (CH)

(73) Assignee: NIVAROX-FAR S.A., Le Locle (CH)

( * ) Notice: Subject to any disclaimer, the term of this patent is extended or adjusted under 35 U.S.C. 154(b) by 193 days.

(21) Appl. No.: 14/895,137

(22) PCT Filed: May 9, 2014

(86) PCT No.: PCT/EP2014/059585
§ 371 (c)(1),
(2) Date: Dec. 1, 2015

(87) PCT Pub. No.: WO2014/198466
PCT Pub. Date: Dec. 18, 2014

(65) Prior Publication Data

US 2016/0124391 A1 May 5, 2016

(30) Foreign Application Priority Data

Jun. 12, 2013 (EP) ..... 13171680

(51) Int. Cl.
*G04B 43/00* (2006.01)
*C22C 38/48* (2006.01)
(Continued)

(52) U.S. Cl.
CPC ..... *G04B 43/007* (2013.01); *B21B 1/22* (2013.01); *B21K 23/00* (2013.01); *B22D 25/026* (2013.01);
(Continued)

(58) Field of Classification Search
CPC ..... B22D 25/026; B24B 1/00; C22C 38/001; C22C 38/02; C22C 38/20; C22C 38/22; C22C 38/38; C22C 38/40; C22C 38/42; C22C 38/44; C22C 38/48; C22C 38/58; C22C 38/60; G04B 13/02; G04B 18/02; G04B 43/007; G04B 15/14; B21B 1/22; B21K 23/00
See application file for complete search history.

(56) References Cited

U.S. PATENT DOCUMENTS

2003/0021716 A1 1/2003 Hauser et al.
2011/0226391 A1* 9/2011 Kim ..... C21D 1/18 148/542

FOREIGN PATENT DOCUMENTS

EP 1 281 785 A2 2/2003
JP 61238943 A * 10/1986
(Continued)

OTHER PUBLICATIONS

International Search Report dated Mar. 23, 2015 in PCT/EP2014/059585 filed May 9, 2014.

*Primary Examiner* — Jenny R Wu
(74) *Attorney, Agent, or Firm* — Oblon, McClelland, Maier & Neustadt, L.L.P.

(57) ABSTRACT

A micromechanical component for a timepiece movement including a metal body formed using a single material. The single material is of high-interstitial austenitic steel type including at least one non-metal as the interstitial atom in a proportion between 0.15% and 1.2% with respect to total mass of the material.

14 Claims, 2 Drawing Sheets

(51) Int. Cl.

| | |
|---|---|
| ***C22C 38/44*** | (2006.01) |
| ***C22C 38/42*** | (2006.01) |
| ***C22C 38/38*** | (2006.01) |
| ***B24B 1/00*** | (2006.01) |
| ***C22C 38/20*** | (2006.01) |
| ***C22C 38/02*** | (2006.01) |
| ***B22D 25/02*** | (2006.01) |
| ***B21B 1/22*** | (2006.01) |
| ***B23K 23/00*** | (2006.01) |
| ***C22C 38/58*** | (2006.01) |
| ***C22C 38/22*** | (2006.01) |
| ***G04B 18/02*** | (2006.01) |
| ***G04B 15/14*** | (2006.01) |
| ***G04B 13/02*** | (2006.01) |
| ***C22C 38/40*** | (2006.01) |
| ***C22C 38/60*** | (2006.01) |
| ***B21K 23/00*** | (2006.01) |
| ***C22C 38/00*** | (2006.01) |

(52) U.S. Cl.

CPC ..... *B24B 1/00* (2013.01); *C22C 38/001* (2013.01); *C22C 38/02* (2013.01); *C22C 38/20* (2013.01); *C22C 38/22* (2013.01); *C22C 38/38* (2013.01); *C22C 38/40* (2013.01); *C22C 38/42* (2013.01); *C22C 38/44* (2013.01); *C22C 38/48* (2013.01); *C22C 38/58* (2013.01); *C22C 38/60* (2013.01); *G04B 13/02* (2013.01); *G04B 15/14* (2013.01); *G04B 18/02* (2013.01)

(56) References Cited

FOREIGN PATENT DOCUMENTS

| | | | | |
|---|---|---|---|---|
| JP | 07157847 | A | * | 6/1995 |
| JP | 2001-11579 | A | | 1/2001 |
| JP | 2001011579 | A | * | 1/2001 |
| JP | 2007-248398 | A | | 9/2007 |

* cited by examiner

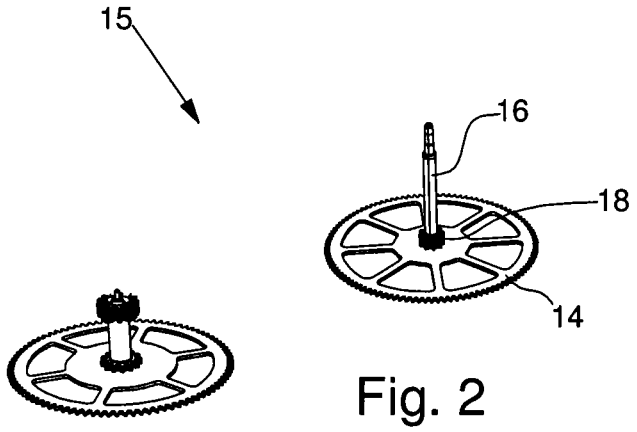
Fig. 2
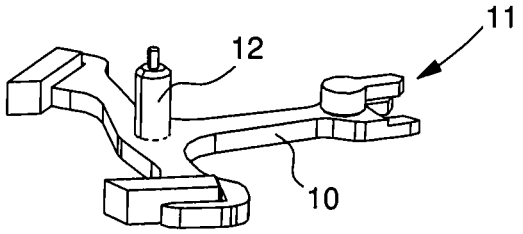
Fig. 3
Fig. 4
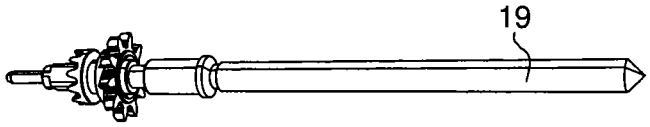
Fig. 5
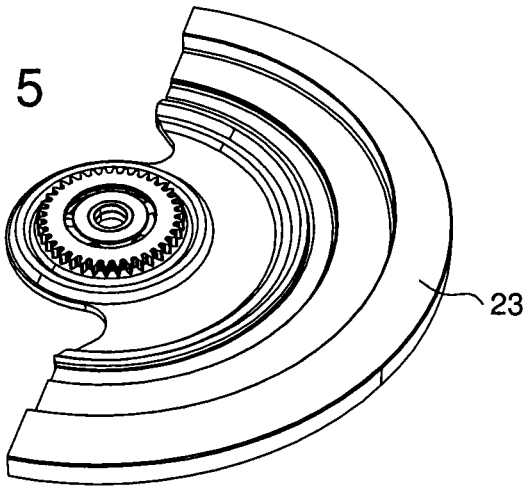

COMPONENT FOR A TIMEPIECE MOVEMENT

CROSS-REFERENCE TO RELATED APPLICATIONS

This is a National phase application in the United States of International Patent Application PCT/EP2014/059585 filed May 9, 2014 which claims priority on European patent application No. 13171680.5 of Jun. 12, 2013. The entire disclosures of the above patent applications are hereby incorporated by reference.

FIELD OF THE INVENTION

The invention relates to a component for a timepiece movement and notably such a component which is insensitive or almost insensitive to magnetic fields, such as all or part of a gear train, all or part of an index system or all or part of an escapement system.

BACKGROUND OF THE INVENTION

It is known to form components for timepiece movements from free-cutting steels which are generally martensitic steels. Known steels of this type are, for example, steel 15P or steel 20AP.

This type of material has the advantage of being easy to machine, in particular of being suitable for bar cutting and, after tempering and quenching treatments, has high mechanical properties that are very advantageous for creating pivoting components for a timepiece movement. After heat treatment, these steels exhibit particularly high wear resistance and hardness (more than 900 HV in the tempered state and between 550 and 850 HV depending on the quenching applied).

Although providing satisfactory mechanical properties for the watchmaking applications described above, this type of material has the drawback of being sensitive to magnetic fields and to corrosion.

There is also resulfurized steel 316L, which has the advantage of being easy to machine, almost insensitive to magnetic fields and almost insensitive to corrosion. However, it has very limited hardness even after strain hardening (around 350 HV), which means that it cannot be used for moving components (shocks and wear) and which makes it incompatible with a finish rolling or burnishing step.

SUMMARY OF THE INVENTION

It is an object of the present invention to overcome all or part of the aforementioned drawbacks by proposing an alternative material enjoying the same advantages as steel 15P and steel 20AP, i.e. easy to machine, with a hardness comprised between 500 HV and 900 HV, without being sensitive to magnetic fields or to corrosion.

To this end, the invention relates to a micromechanical component for a timepiece movement including a metal body formed using a single high-interstitial austenitic steel type material including at least one non-metal as the interstitial atom, characterized in that said at least one non-metal is present in a proportion comprised between 0.15% and 1.2% by mass with respect to the total mass of said single material.

Consequently, it is understood that with the aid of said austenitic steel, the micromechanical component is, surprisingly, chemically and physically stable with the use of a single totally homogeneous material even in the event of exposure to external magnetic fields or to oxidising atmospheres.

According to other advantageous features of the invention:

- said at least one non-metal is nitrogen and/or carbon;
- said at least one non-metal includes nitrogen and carbon and the sum of the mass percent composition of carbon and of nitrogen in the metal body is comprised between 0.6% and 0.95%;
- said at least one non-metal includes nitrogen and carbon and the ratio of the mass percent composition of carbon and of nitrogen in the metal body is comprised between 0.25 and 0.55;
- the sum of the mass percent composition of carbon and of nitrogen in the metal body is substantially equal to 0.8% and the ratio of the mass percent composition of carbon and of nitrogen in the metal body is substantially equal to 0.45;
- the high-interstitial austenitic steel is of the austenitic stainless steel type including at least 10% chromium and at least 5% nickel and/or manganese;
- the high-interstitial austenitic steel further includes between 0.5 and 5 mass percent of molybdenum and/or copper in order to improve its resistance to corrosion;
- the micromechanical component forms all or part of a gear train, of an index system or of an escapement system;
- the micromechanical component forms a pivot arbor, a collet, a screw, a pallet-staff, a wheel plate, a pinion plate, an index plate, an escape wheel plate, a pallet lever, a main plate, a bridge, a winding stem, a barrel arbor, a casing clamp or an oscillating weight.

Further, the invention relates to a timepiece characterized in that it includes at least one micromechanical component according to any of the preceding variants.

As a result, surprisingly, it is clear that when using said high interstitial austenitic steel, advantageously according to the invention, there is no need for any material hardening treatment such as carburizing or nitriding, any chemical protection of the material or magnetic shielding treatment, in order to use said micromechanical component in a timepiece movement, even in the event of exposure to external magnetic fields or to oxidising atmospheres.

Finally, the invention relates to a method for fabricating a micromechanical component including the following steps:

a) taking a high-interstitial austenitic steel type material comprising at least one non-metal as the interstitial atom, said at least one non-metal being present in a proportion comprised between 0.15% and 1.2% with respect to the total mass of said material;

b) forming, using only said material, a micromechanical component.

According to other advantageous features of the invention:

- said at least one non-metal is nitrogen and/or carbon;
- said at least one non-metal include nitrogen and carbon and the sum of the mass percent composition of carbon and of nitrogen in the metal body is comprised between 0.6% and 0.95%;
- said at least one non-metal includes nitrogen and carbon and the ratio of the mass percent composition of carbon and of nitrogen in the metal body is comprised between 0.25 and 0.55;
- the sum of the mass percent composition of carbon and of nitrogen in the metal body is substantially equal to 0.8% and the ratio of the mass percent composition of carbon and of nitrogen in the metal body is substantially equal to 0.45;

the high-interstitial austenitic steel is of the austenitic stainless steel type including at least 10% chromium and at least 5% nickel and/or manganese;

the high interstitial austenitic steel includes bismuth, lead, tellurium, selenium, calcium, sulphur or manganese with sulphur;

according to a first embodiment, step b) includes a phase of deformation of said material into the form of a strip;

the deformation phase is followed by a cutting phase to form said micromechanical component in one portion of the strip;

according to a second embodiment, step b) includes a phase of deformation of said material into the form of a bar or a wire;

the deformation phase is followed by a cutting phase to form said micromechanical component in one portion of the bar or wire;

according to the second embodiment, step b) includes a final finish rolling or a burnishing phase;

the method includes, after step b), a final polishing and/or heat treatment step.

BRIEF DESCRIPTION OF THE DRAWINGS

Other features and advantages will appear clearly from the following description, given by way of non-limiting illustration, with reference to the annexed drawings, in which:

FIG. 2 is a partial view of a gear train according to the invention;

FIG. 3 is a view of a pallets according to the invention;

FIG. 4 is a view of a winding stem according to the invention;

FIG. 5 is a view of an oscillating weight according to the invention.

DETAILED DESCRIPTION OF PREFERRED EMBODIMENTS

Figure 1:
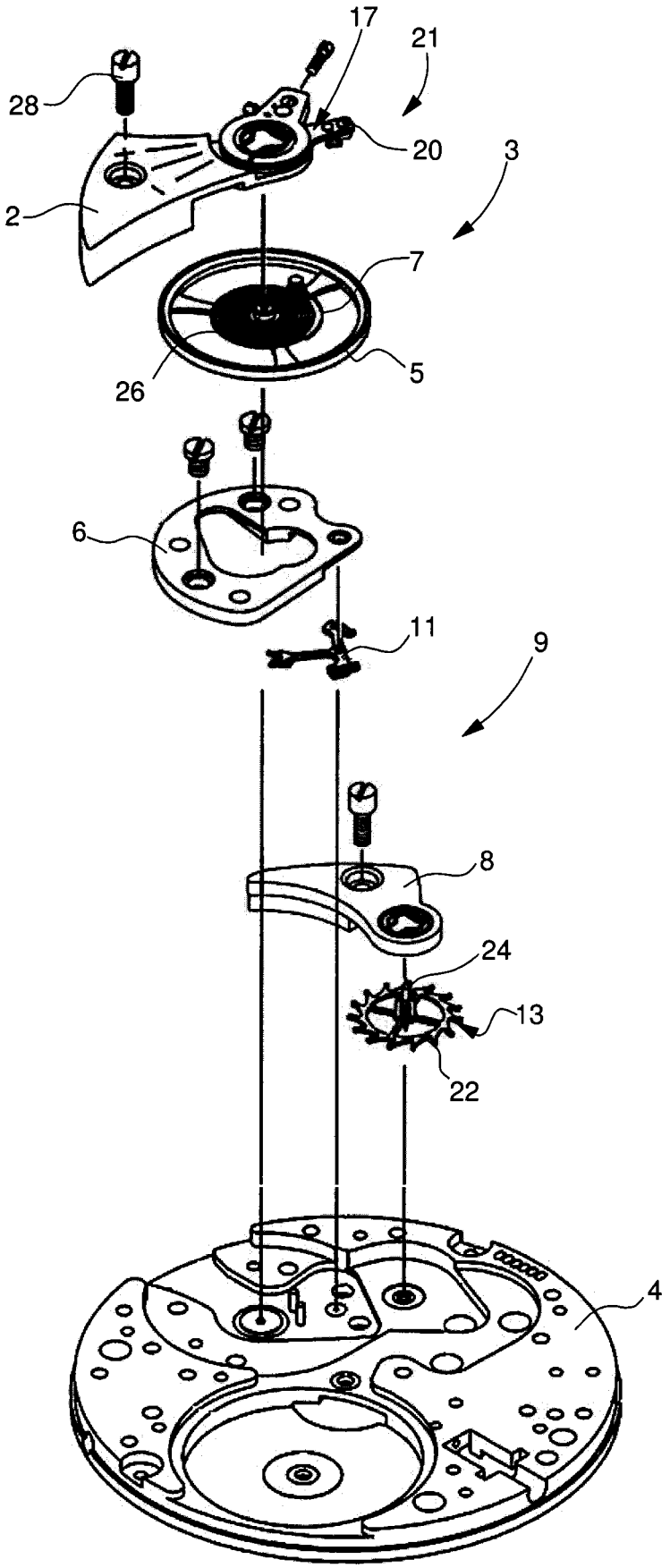
FIG. 1 is an exploded view of a timepiece movement according to the invention.

FIG. 1 shows a partial view of a timepiece movement 1 according to the invention, intended to be mounted in a timepiece. Movement 1 preferably includes a resonator 3 comprising a balance 5 and a balance spring 7 for regulating movement 1. Resonator 3 is preferably mounted to pivot notably by means of a collet 26 of balance spring 7 mounted on an arbor, between a bridge 2 and a main plate 4 and includes an index system 21 mounted on bridge 2 mainly comprising an index 17. It can be seen in FIG. 1 that bridge 2 is fixed to main plate 4, notably by means of a screw 28.

FIG. 1 also shows that movement 1 preferably includes an escapement system 9 comprising a Swiss lever 11 and an escape wheel 13 intended to distribute to gear train 15 the motions of the resonator and also to maintain them. Escapement system 9 is preferably mounted between two bars 6, 8 and main plate 4.

Finally, gear train 19 is intended to transmit the energy from the barrel (not shown) to the resonator and also to rewind the barrel, for example by means of a winding stem 19, a barrel arbor, casing clamps or an oscillating weight 23.

All or part of these micromechanical components are currently formed from steel 15P and steel 20AP and are thus sensitive to magnetic fields and to corrosion. Although this sensitivity may be directly inconvenient in the case of a moving component, it may also be indirectly inconvenient by affecting another adjacent component.

Consequently, the invention relates to a micromechanical component for a timepiece movement including a metal body formed of a single high-interstitial austenitic steel type material. In the present description, 'austenitic steel' means an alloy including mostly iron in substantially austenitic form. Indeed, in any production system, it is difficult to ensure that the entire structure is austenitic.

Thus, advantageously according to the invention, following development studies, surprisingly it has been possible to fabricate austenitic stainless steel parts which are insensitive or almost insensitive to external magnetic fields and to oxidising atmospheres using a single material.

This high-interstitial austenitic steel includes at least one non-metal such as nitrogen and/or carbon as the interstitial atom homogeneously distributed in the material, i.e. throughout the metal body, comprised between 0.15% and 1.2% with respect to the total mass of said metal body. It is therefore understood that the austenitic steel according to the invention may include exclusively interstitial carbon atoms, exclusively interstitial nitrogen atoms, or both carbon atoms and nitrogen atoms.

It has also been demonstrated that, in the case where the interstitial atoms are formed by carbon and by nitrogen, the properties are optimal for fabricating timepiece components where the sum of the mass percent composition of carbon and of nitrogen in the metal body is comprised between 0.6% and 0.95% and/or where the ratio of the mass percent composition of carbon and of nitrogen in the metal body is comprised between 0.25 and 0.55.

Further, preferably, the high-interstitial austenitic steel is of the austenitic stainless steel type including at least 10% chromium and at least 5% nickel and/or manganese, with the remainder being iron. It is thus clear that the austenitic steel according to the invention may include only at least 5% nickel with respect to the total mass of said metal body, only at least 5% manganese with respect to the total mass of said metal body, or at least 5% nickel with respect to the total mass of said body and at least 5% manganese with respect to the total mass of said metal body.

By way of non-limiting example, an entirely satisfactory chromium-manganese type austenitic steel was developed, in which the sum, i.e. C+N is substantially equal to 0.8% by mass with respect to the total mass of the metal body and the carbon-to-nitrogen ratio, i.e. C/N is substantially equal to 0.45. Alloy 1 of Table 1 below exhibits these proportions.

More generally, any gammagenous element, i.e. promoting the γ phase of a steel, can replace all or part of the manganese in order to promote the austenitic phase such as, for example, cobalt or copper. The replacement proportions of cobalt and/or copper can be determined using the following model:

$$\text{Nickel equivalent}=(\%\ \text{Ni})+(\%\ \text{Co})+0.5(\%\ \text{Mn})+30(\%\ \text{C})+0.3(\%\ \text{Cu})+25(\%\ \text{N})$$

where the percentages represent the mass proportion of the material relative to the total mass of the metal body.

According to a particular alternative, the steel according to the invention may also include bismuth, lead, tellurium, selenium, calcium, sulphur and/or sulphur with manganese (when the steel does not include manganese) as additive in order to improve the machinability of said micromechanical component. Indeed, it has been demonstrated that these components used alone or in combination as additives allow discontinuities of material to form in the material capable of limiting the length of chips and consequently facilitating machining of said material. The proportion of bismuth, lead, tellurium, selenium, calcium, sulphur and/or sulphur with manganese (when the steel does not include manganese) is preferably comprised between 0.05% and 3% by mass with respect to the total mass of the metal body.

Consequently, in view of the aforecited advantages, it has been demonstrated that, preferably, the micromechanical component according to the invention is particularly advantageous in a timepiece when it forms all or part of a gear train 15, such as a wheel plate 14, a pinion plate 18 or a pivot arbor 16, all or part of an index system 21 such as a plate 20 of an index 17 or all or part of an escapement system 9, such as a plate 22 of an escape wheel 13, a pivot arbor 24, a lever 10 of a pallets 11 or a staff 12 of a pallets 11.

Of course, although not preferred, other micromechanical components may be envisaged even if they are not usually made of steel 15P steel or steel 20AP. Thus, in a non-limiting manner, it is possible, in particular, to envisage forming main plate 4 and/or bridges 2, 6, 8 and/or winding stem 19 and/or oscillating weight 23 and/or collet 26 and/or screw 28 using a high-interstitial austenitic steel according to the invention.

Table 1 below gives example alloys which may be used to form micromechanical components according to the invention:

TABLE 1

Example alloys according to the invention

| | C | N | Cr | Mn | Mo | Si | Cu | Ni | Nb | Fe |
|---|---|---|---|---|---|---|---|---|---|---|
| 1 | 0.15-0.25 | 0.45-0.55 | 16.50-18.00 | 9.50-12.50 | 2.70-3.70 | 0.20-0.60 | 0.25 | | | Remainder |
| 2 | 0.11 | 0.25 | 18.5 | 6 | | 0.8 | | 7 | | Remainder |
| 3 | 0.08 | 0.90 | 19.00-23.00 | 21.00-24.00 | 0.50-1.50 | 0.75 | 0.25 | 0.10 | | Remainder |
| 4 | 0.08 | 0.95 | 21 | 23 | 0.7 | | | 0.30 | | Remainder |
| 5 | 0.04 | 0.4 | 21.3 | 3.6 | 2.4 | 0.25 | | 9.5 | 0.35 | Remainder |
| 6 | 0.06 | 0.81 | 16.55 | 12.93 | 3.1 | 0.98 | | 0.29 | | Remainder |
| 7 | 0.06 | 0.89 | 18.03 | 18.8 | | 0.31 | | 0.37 | | Remainder |
| 8 | 0.04 | 1.01 | 20.92 | 23.32 | 0.69 | 0.22 | | | | Remainder |
| 9 | 0.041 | 0.81 | 17.81 | 18.64 | 1.88 | 0.06 | | 0.07 | | Remainder |
| 10 | 0.03 | 0.8 | 20.69 | 9.82 | 2.41 | 0.2 | | 0.10 | | Remainder |
| 11 | 0.03 | 0.5 | 25.0 | 6.0 | 5.0 | | | 17.0 | 0.45 | Remainder |
| 12 | 0.03 | 0.2 | 17.5 | 1.0 | 4.0 | | | 13.5 | | Remainder |

During development studies, it became clear that alloys 1 and 2 were the most satisfactory for watchmaking applications. As explained above, alloy 1 is entirely satisfactory as regards machinability and hardness (between 600 HV and 900 HV, i.e. substantially equivalent to steel 20AP) without being sensitive to magnetic fields or to corrosion. Alloy 2 was less hard than alloy 1 (between 500 HV and 700 HV) but still remains superior to the hardness of steel 316L and is therefore compatible with the fabrication of moving parts and also with finish rolling or burnishing steps.

The invention also relates to a method for fabricating a micromechanical component including the following steps:

a) taking a high-interstitial austenitic steel type material comprising at least one non-metal as the interstitial atom, said at least one non-metal being present in a proportion comprised between 0.15% and 1.2% with respect to the total mass of said material;

b) forming, using only said material, a micromechanical component.

One of the advantages of the invention will be understood immediately. Indeed, a high-interstitial austenitic steel does not require any complicated implementation steps, in particular, any hardening treatment to a certain thickness of the material, any chemical protection of the material or any magnetic shielding treatment.

Indeed, surprisingly, high-interstitial austenitic steels conform to the high requirements of the watch industry with no particular dedicated protective treatment against magnetic fields and corrosion.

As explained above, step a) consists mainly in casting a high-interstitial austenitic steel including at least one non-metal as the interstitial atom, such as nitrogen and/or carbon, homogeneously distributed in the material, i.e. throughout the metal body, comprised between 0.15% and 1.2% with respect to the total mass of said metal body.

According to a preferred alternative, the sum of the mass percent composition of carbon and of nitrogen in the metal body is substantially equal to 0.60% and 0.95% and/or the ratio of the mass percent composition of carbon and of nitrogen in the metal body is comprised between 0.25 and 0.55.

Further, preferably, the high-interstitial austenitic steel according to the invention is of the austenitic stainless steel type including at least 10% chromium and at least 5% nickel and/or at least 5% manganese, with the remainder being iron.

By way of non-limiting example, a chromium-manganese type austenitic steel, in which the sum, i.e. C+N, is substantially equal to 0.8% by mass with respect to the total mass of the metal body and the carbon-to-nitrogen ratio, i.e. C/N, is substantially equal to 0.45, is entirely satisfactory. Alloy 1 of Table 1 above exhibits these proportions.

According to a particular alternative, the high-interstitial austenitic steel according to the invention may also include bismuth, lead, tellurium, selenium, calcium, sulphur and/or sulphur with manganese (when the steel does not include manganese) in a proportion comprised between 0.05% and 3% by mass of the total mass of the metal body in order to improve the machinability of said micromechanical component.

Thus, according to a first embodiment, step b) includes a phase of deformation of said material into the form of a strip. The deformation phase is then followed by a cutting phase to form said micromechanical component in one portion of the strip. The cutting phase, in the first embodiment, preferably includes stamping a blank of the component and then machining functional surfaces followed by grinding.

By way of example, the first embodiment makes it possible to form wheel plates 14, pinion plates 18, a plate 20 of an index 17, plates 22 of an escape wheel 13, collets 26 or a lever 10 of a pallets 11.

According to a second embodiment, step b) includes a phase of deformation of said material into the form of a bar or a wire. The deformation phase is then followed by a cutting phase to form said micromechanical component in one portion of the bar or wire. The cutting phase, which can be considered as a turning phase, in the second embodiment, preferably includes profile-turning of the functional surfaces, possibly followed by grinding. Finally, in the method according to the second embodiment, step b) includes a final finish rolling or burnishing phase. The second embodiment can, for example, form pivot arbors 16, 24, collets 26, screws 28 or staffs 12 of pallets 11.

Of course, the present invention is not limited to the illustrated example but is capable of various variants and modifications that will appear to those skilled in the art. In particular, the method may include, after step b), a final polishing and/or heat treatment step intended to finish the micromechanical component.

Further, in order to improve resistance to corrosion, the high-interstitial austenitic steel may also include molybdenum in a proportion comprised between 0.5% and 5% by mass with respect to the total mass of the metal body and/or copper in a proportion comprised between 0.5% and 5% by mass with respect to the total mass of the metal body.

Finally, in order to offer a deoxidization effect, i.e. to limit oxygen in the melted material, during casting steps, the high-interstitial austenitic steel may also include silicon in a proportion substantially lower than or equal to 0.6% by mass with respect to the total mass of the metal body and/or manganese in a proportion substantially lower than or equal to 0.6% by mass with respect to the total mass of the metal body.

The invention claimed is:

1. A micromechanical component for a timepiece movement comprising:

a metal body formed using a single material that is an interstitial austenitic steel material including at least nitrogen and carbon as interstitial atoms homogeneously distributed throughout the interstitial austenitic steel material, wherein the interstitial austenitic steel consists of C, N, Cr, Mn, Mo, Si, Cu, and Fe, wherein the sum of the mass percent composition of carbon and of nitrogen in the metal body is between 0.61% and 0.80%, and the ratio of the mass percent composition of carbon and of nitrogen in the metal body is between 0.29 and 0.55, wherein the mass percentage of carbon in the metal body is between 0.16% and 0.25% and the mass percentage of nitrogen in the metal body is between 0.45% and 0.55%, wherein the interstitial austenitic steel includes between 2.70% and 3.70% by mass of molybdenum, and wherein the interstitial austenitic steel material includes a hardness comprised between 500 MV and 900 MV without the interstitial austenitic steel material being hardened with any material hardening treatment.

2. The micromechanical component according to claim 1, wherein the mass percentage of carbon in the metal body is between 0.17% and 0.25%.

3. The micromechanical component according to claim 1, wherein the sum of the mass percent composition of carbon and of nitrogen in the metal body is equal to 0.8% and the ratio of the mass percent composition of carbon and of nitrogen in the metal body is equal to 0.45.

4. The micromechanical component according to claim 1, wherein an amount of chromium in the interstitial austenitic steel is at least 10% by mass and an amount of manganese in the interstitial austenitic steel is at least 5% by mass.

5. The micromechanical component according to claim 4, wherein an amount of coper in the interstitial austenitic steel is between 0.5% and 5% by mass.

6. The micromechanical component according to claim 1, wherein the interstitial austenitic steel is insensitive to magnetic fields.

7. The micromechanical component according to claim 1, wherein the interstitial austenitic steel is insensitive to corrosion.

8. The micromechanical component according to claim 1, wherein an amount of silicon in the interstitial austenitic steel is 0.6% or less by mass.

9. The micromechanical component according to claim 1, wherein the micromechanical component is usable in the timepiece movement without any material hardening treatment to the interstitial austenitic steel, without any chemical protection of the interstitial austenitic steel, and without any magnetic shielding treatment to the interstitial austenitic steel.

10. The micromechanical component according to claim 1, wherein an amount of chromium in the interstitial austenitic steel is between 16.50% and 18.00% by mass.

11. The micromechanical component according to claim 1, wherein an amount of manganese in the interstitial austenitic steel is between 9.50% and 12.50% by mass.

12. A method for fabricating the micromechanical component according to claim 1, comprising:

a) taking the interstitial austenitic steel material, in which at least nitrogen and carbon as interstitial atoms are homogeneously distributed throughout the interstitial austenitic steel material, the sum of the mass percent composition of carbon and of nitrogen in the metal body is between 0.61% and 0.80% and the ratio of the mass percent composition of carbon and of nitrogen in the metal body is between 0.29 and 0.55, and the interstitial austenitic steel material includes a hardness comprised between 500 HV and 900 HV without the interstitial austenitic steel material being hardened with any material hardening treatment; and b) forming, using only the material, the micromechanical component, wherein the mass percentage of carbon in the metal body is between 0.16% and 0.25% and the mass percentage of nitrogen in the metal body is between 0.45% and 0.55%.

13. The method according to claim 12, wherein the sum of the mass percent composition of carbon and of nitrogen in the metal body is substantially equal to 0.8% and the ratio of the mass percent composition of carbon and of nitrogen in the metal body is substantially equal to 0.45.

14. The method according to claim 12, wherein an amount of chromium in the interstitial austenitic steel is at least 10% by mass and an amount of manganese in the interstitial austenitic steel is at least 5% by mass.

* * * * *